US007367863B2

(12) United States Patent
Fosbenner et al.

(10) Patent No.: US 7,367,863 B2
(45) Date of Patent: May 6, 2008

(54) TOY VEHICLE HAVING ROTATABLE LIGHT DISPLAY

(75) Inventors: Mary Ellen Fosbenner, Riverton, NJ (US); Anthony P. Monzo, Redondo Beach, CA (US); Robert Jude Henry, Bethlehem, PA (US)

(73) Assignee: Mattel, Inc., El Segundo, CA (US)

( * ) Notice: Subject to any disclaimer, the term of this patent is extended or adjusted under 35 U.S.C. 154(b) by 130 days.

(21) Appl. No.: 11/138,890

(22) Filed: May 26, 2005

(65) Prior Publication Data

US 2006/0009118 A1 Jan. 12, 2006

Related U.S. Application Data

(60) Provisional application No. 60/575,292, filed on May 28, 2004.

(51) Int. Cl.
*A63H 17/28* (2006.01)

(52) U.S. Cl. ..... 446/438; 446/485

(58) Field of Classification Search ..... 340/471, 340/472, 473; 362/35, 459, 487, 488; 446/438, 446/439, 462, 465, 485
See application file for complete search history.

(56) References Cited

U.S. PATENT DOCUMENTS 3,764,799 A * 10/1973 Schulz ..... 362/35
4,114,309 A 9/1978 Gay
4,193,223 A * 3/1980 D'Andrade et al. ..... 446/438
4,229,781 A * 10/1980 Hitora ..... 362/274
4,598,976 A * 7/1986 McNett ..... 359/522
4,604,075 A 8/1986 Richards et al.
4,728,311 A 3/1988 Magers
4,925,427 A 5/1990 Wu
5,030,160 A * 7/1991 Klawitter ..... 446/242
5,069,649 A 12/1991 Wu
5,084,803 A 1/1992 Lan
5,207,496 A * 5/1993 Stanuch et al. ..... 362/35
5,411,429 A 5/1995 Klawiter
5,426,417 A * 6/1995 Stanuch ..... 340/473
5,517,388 A * 5/1996 Hutchisson ..... 362/35
5,542,872 A 8/1996 Ho
5,641,317 A 6/1997 Huang
5,735,727 A 4/1998 Tsai
5,766,056 A 6/1998 Tsai
5,791,967 A 8/1998 Yeh
5,807,158 A 9/1998 Tsai
5,810,638 A 9/1998 Wood
6,000,988 A 12/1999 Tsai (Continued)

*Primary Examiner*—John A. Ricci
(74) *Attorney, Agent, or Firm*—Panitch Schwarze Belisario & Nadel LLP

(57) ABSTRACT

A toy vehicle with a rotatable light display. The toy vehicle includes a housing defined by outer walls surrounding a hollow interior and at least substantially forming a toy vehicle body. The housing has a plurality of openings through the outer walls. At least translucent panels are coupled to the housing and aligned with the plurality of openings. A motor is mounted within the hollow interior. A light source is within the hollow interior. A rotatable member is drivingly connected to the motor in the interior so as to be rotated by operation of the motor. The rotatable member is positioned with respect to the light source so as to direct at least one beam of light emitted from the light source about the hollow interior and sequentially and cyclically through the plurality of openings and aligned translucent panels.

24 Claims, 13 Drawing Sheets

U.S. PATENT DOCUMENTS 6,033,285 A 3/2000 Fine et al.
6,152,801 A 11/2000 Tsai
6,755,716 B2 6/2004 Agostini et al.
6,764,376 B2 7/2004 Agostini et al.
2001/0037773 A1 11/2001 Nathanson et al.
2005/0042974 A1 2/2005 Agostini et al.

* cited by examiner

TOY VEHICLE HAVING ROTATABLE LIGHT DISPLAY

CROSS-REFERENCE TO RELATED APPLICATIONS

This patent application claims priority to U.S. Provisional Patent Application No. 60/575,292, filed May 28, 2004, entitled "Toy Vehicle Having Rotatable Light Display", the disclosure of which is incorporated herein by reference.

BACKGROUND OF THE INVENTION

This invention generally relates to toys and, more particularly, to toy vehicles having rotatable light displays. It is believed that a toy with such a light display would be desirable.

BRIEF SUMMARY OF THE INVENTION

Briefly stated, the present invention is a toy vehicle with a rotatable light display. The toy vehicle comprises a housing defined by outer walls surrounding a hollow interior and at least substantially forming a toy vehicle body. The housing has a plurality of openings through the outer walls. At least translucent panel means is coupled to the housing and aligned with the plurality of openings. A motor is mounted within the hollow interior. A light source is within the hollow interior. A rotatable member is drivingly connected to the motor in the interior so as to be rotated by operation of the motor. The rotatable member is positioned with respect to the light source so as to direct at least one beam of light emitted from the light source about the hollow interior and sequentially and cyclically through the plurality of openings and aligned translucent panel means.

In another aspect, the present invention is in a toy vehicle having a housing defined by outer walls surrounding a hollow interior. The housing has a plurality of openings through the outer walls and at least translucent panel means coupled to the housing and aligned with the plurality of openings. The vehicle further has a motor disposed within the hollow interior. A rotatable light display comprises a light source within the hollow interior. A rotatable member is drivingly connected to the motor in the hollow interior so as to be rotated by operation of the motor The rotatable member is positioned with respect to the light source so as to direct at least one beam of light emitted from the light source about the hollow interior and sequentially and cyclically through the plurality of openings and aligned translucent panel means.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
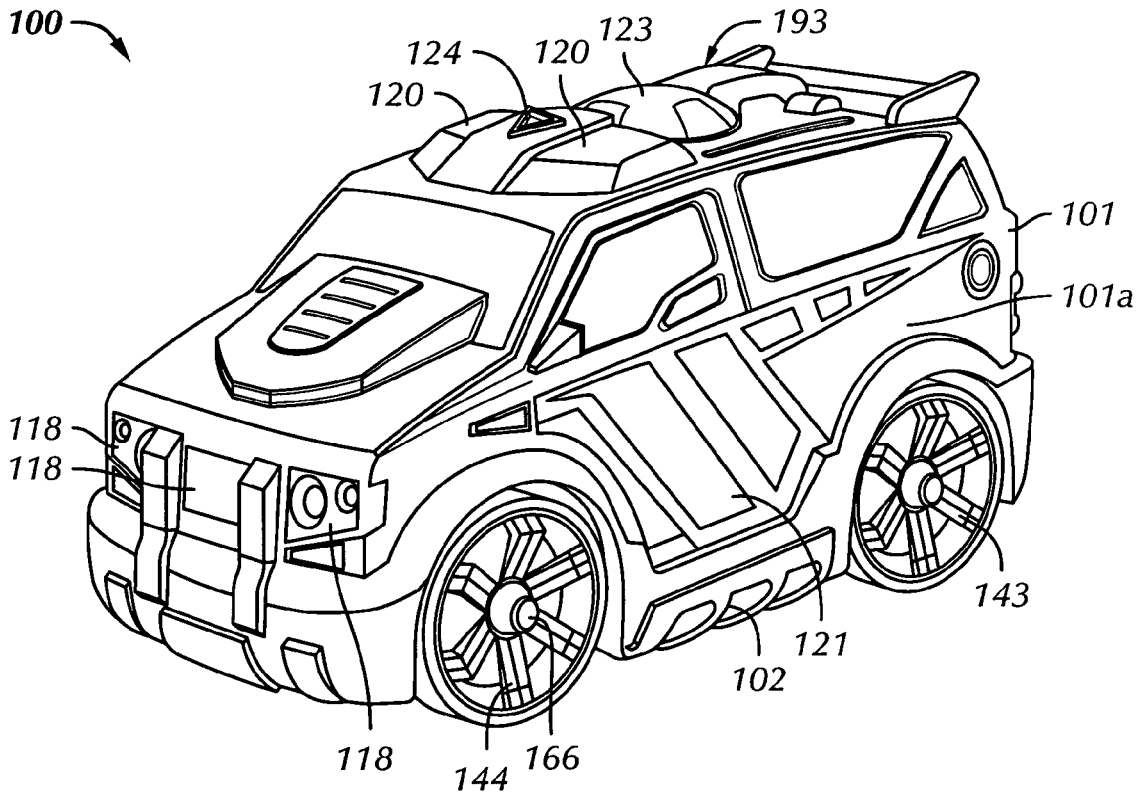
FIG. 1 is a front right perspective view of a toy vehicle in accordance with a first preferred embodiment of the present invention.

Certain terminology is used in the following description for convenience only and is not limiting. The words "right", "left", "upper", and "lower" designate directions in the drawings to which reference is made. The terminology includes the words above specifically mentioned, derivatives thereof, and words of similar import.

Figure 2:
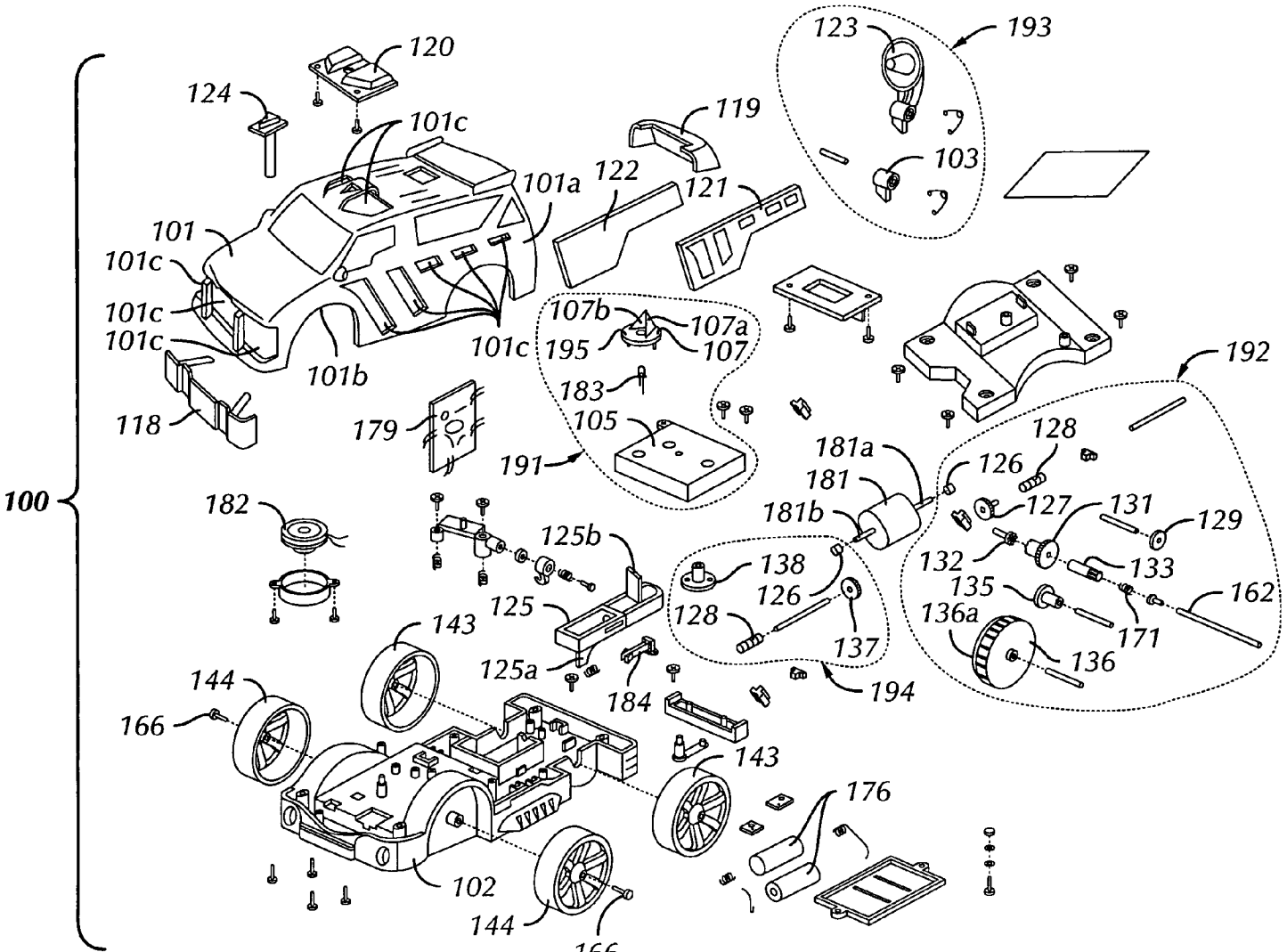
FIG. 2 is an exploded view of the toy vehicle of FIG. 1.

Referring to the drawings in detail, wherein like numerals indicate like elements throughout, there is shown in FIGS. 1-2, a first preferred embodiment of a toy vehicle, indicated generally at 100, having a rotatable light display 191, in accordance with the present invention. The toy vehicle 100 is preferably styled to resemble a police vehicle. The toy police vehicle 100 has a housing or body 101 mounted on top of a chassis 102. The housing 101 is defined by outer walls 101*a* surrounding a hollow interior 101*b* and at least substantially forming a toy vehicle body. The housing 101 preferably has a plurality of openings 101*c* through the outer walls 101*a*.

The toy police vehicle 100 further includes a plurality of road wheels preferably in the form of front and rear wheels 144, 143, which are rotatably engaged with the housing 101 so as to support the housing 101 for movement across a surface (not shown). At least one of the plurality of road wheels 143, 144 is drivingly connected with a motor 181 (described below) such that operation of the motor 181 causes rotation of the at least one road wheel 143, 144. Preferably, there are two front wheels 144 and two rear wheels 143, although it is within the spirit and scope of the present invention that there be more or less than two front or rear wheels 144, 143. Additionally, it is preferable that the front wheels 144 be freely rotatable about pins 166 and the back wheels 143 are powered, as described below.

Preferably, the toy police vehicle 100 has a generally transparent or at least translucent panel means for emitting light therethrough coupled to the housing 101 and aligned with the plurality of openings 101*c*. The panel means is intended to be at least translucent in that it should be able to allow at least some light to pass therethrough. That is, the panel means should not be opaque.

Preferably, the panel means includes a plurality of individual panels including a top lights panel 120, a headlights panel 118, a rear panel 119, and left and right side body panels 121, 122. Preferably, each of the panel means has a plurality of raised transparent segments received in the openings 101*c* of the body 101 that effectively define sets of adjoining windows. As will be described below, the panel means cyclically emits light from a light source such as a light emitting diode (LED) 183, for instance, located within the hollow interior 101*b* of the body 101. Although it is preferred that the panel means includes a plurality of panels 118, 119, 120, 121, 122, it is within the spirit and scope of the present invention that the panel means is formed by a single strip (not shown), ring (not shown), or dome (not shown) of at least translucent material positioned within the housing 101, outside of the housing 101, or sandwiched within the housing 101 in some manner to retain the panel means in a position that aligns at least some portions of the panel means with the openings 101*c* of the housing 101.

Preferably, the motor 181 is disposed within the body 101 mounted within the hollow interior 101*b*, preferably engaged with the chassis 102. The motor 181 is preferably an electric motor 181 powered by at least one battery 176, preferably two batteries 176, within the toy police vehicle 100.

Preferably disposed on a top of the body 101 is a pop-out/pop-up accessory or movable member 193 in the form of a pivotable pop-up radar 123. The movable member 193 is mounted on the body 101 and is operably connected to the motor 181, such that operation of the motor 181 causes movement of the movable member 193 with respect to the housing 101. The movable member 193 preferably pops up from the body 101 upon actuation of the toy police vehicle 100 by a user, as described below.

Preferably, the toy police vehicle 100 includes an actuator button 124 disposed thereon, preferably on the top of the body 101. Movement of the button 124 preferably causes at least powering of the LED 183 or other light source and initiates the cyclic lighting of the panel means, as will be discussed below. Actuation of the button 124 preferably also initiates the powered rotation of the rear wheels 143. The motor 181 preferably is drivingly connected to the pop-up radar 123, the rear wheels 143, and with means for cyclically lighting the panel means of the body 101, as will be described below.

Referring now to FIG. 2, the motor 181 has two output shafts 181*a*, 181*b*. The first output shaft 181*a* extends rearwardly from the motor 181 and drives a first gear train 192 to rotate the rear wheels 143, lift the pop-up radar 123, and control the operating cycle of the toy police vehicle 100. The second output shaft 181*b* extends forwardly from the motor 181 to drive a second gear train 194 in order to perform the cyclical lighting of the generally transparent/translucent panels 118, 119, 120, 121, 122.

Turning first to the first gear train 192, a pinion 126 is driven by the first output shaft 181*a*. The pinion 126 drives a spur gear 127 which causes rotation of a worm gear 128. The worm gear 128 engages with a spur gear 129, which, in turn, engages another spur gear 131. The spur gear 131 is disposed on a rear axle 162 to which the rear wheels 143 are engaged (one rear wheel 143 is fixedly engaged with each end of the rear axle 162 for rotation with the axle). The spur gear 131 is biased toward a bearing 132 by a spring 171. The bearing 132 is fixed to the back axle 162 and has a serrated, tooth-like pattern on one side which engages with a side of the spur gear 131 having a corresponding serrated, tooth-like pattern, thereby acting as a slip clutch. In this way, if the rear wheels 143 become bound and are unable to rotate while the motor 181 is powered and spinning, the spur gear 131 can slide away from the bearing 132 along the back axle 162 to disengage from the bearing 132 to cease attempted rotation of the rear wheels 143 and reduce damage to the first gear train 162 and/or the motor 181. In this way, the rear wheels 143 are powered by the motor 181.

It is preferred that at least the LED 183 (or other light source) and motor 181 operate for a predetermined amount of time before automatically shutting off. A spur gear 133 is disposed on the rear axle 162 and is engaged to another side of the spur gear 131 through a slip clutch similar to that described above. The spur gear 133 rotates with the spur gear 131 and engages with a spur gear 135, which, in turn, engages with a timing gear 136. The timing gear 136 functions to define a run-time duration of the motor 181, as is described hereafter. A cam surface 136*a* is disposed on one side of the timing gear 136. The cam surface 136*a* engages with a protrusion 125*a* of a pop-up lever 125. The lever 125 is normally spring-biased toward a position where the protrusion 125*a* is out of contact with a leaf switch 184 and the leaf switch 184 is open, such that power is cut from the batteries 176 to maintain the toy police vehicle 100 in an unpowered state. However, when a user manually actuates the button 124, a portion of the button 124 initially contacts the leaf switch 184 to close the leaf switch 184, thereby electrically connecting the batteries 176 to the motor 181 and a circuit board 179 and beginning a run cycle. As the motor 181 begins rotating the timing gear 136, the cam surface 136*a* pushes against the protrusion 125*a* to slide the lever 125 forwardly into contact with the leaf switch 184, keeping the leaf switch 184 closed and continuing the run cycle.

As the lever 125 slides forwardly, a lever member 125*b*, extending upwardly from the lever 125, interacts with a pop-up linkage 103, causing the pop-up linkage 103 to rotate. The pop-up linkage, in turn, engages with the pop-up radar 123 to allow the pop-up radar 123 to lift during the run cycle. The cam surface 136*a* continues to press upon the protrusion 125*a* to continue the run cycle until the timing gear 136 has rotated one complete rotation. At this time, a break or void (not shown) in the cam surface 136*a* allows the protrusion 125*a* to snap back to its original, spring-biased position, out of contact with the leaf switch 184, to terminate power to the motor 181 and end the run cycle. In doing so, the pop-up lever 125 and the lever member 125*b* slide rearwardly into their original position, allowing the pop-up linkage 103 to rotate back to its original position to lower the pop-up radar 123.

Although the above description of the operation of the run cycle of the toy police vehicle 100 is preferred, it is not intended to be limiting. For instance, alternatively, the run cycle could be controlled by a microprocessor on the circuit board 179 which could be triggered by a change in state of the leaf switch 184 or some other microswitch. That is, the leaf switch 184 or other switch could be positioned where it can be closed or, alternatively, opened by the lever 125 or directly by the portion of the button 124 in order to initiate a run cycle routine of the microprocessor.

Turning now to the second gear train 194, a pinion 126 is engaged to the second output shaft 181*b* of the motor 181. The pinion 126 engages with and drives a spur gear 137. Rotation of the spur gear 137 causes rotation of a worm gear 128 which engages with and rotates a crown gear 138. Fixed to the crown gear 138 is a rotatable member 195, which is drivingly connected to the motor 181 in the interior 101*b* so as to be rotated by operation of the motor 181 and positioned with respect to the LED 183 or other light source. In this way, at least one beam of light emitted from the LED 183 or other light source is directed about the hollow interior 101*b* and sequentially and cyclically through the plurality of openings 101*c* and aligned translucent panel means.

In one aspect of the present invention, the LED 183 or other light source is fixedly and stationarily mounted to the housing 101 extending at least into the rotatable member 195 so as to be at least partially shielded by the rotation member 195. In one version of this aspect of the present invention, the rotatable member 195 is a spinning disc 107. The disc 107 is generally circular and has a hollow, generally conical hollow protrusion 107*a* extending upwardly from a top surface thereof. The protrusion 107*a* is generally centrally located on the disc 107 above a hole through the center of the disc 107. The protrusion 107*a* further has a radial cutout 107*b* to form a hollow partial cover over the opening. Disposed within the hole in the center of the disc 107 is the LED 183 or other light source. The LED 183 is stationary and does not rotate with the disc 107 and the crown gear 138. However, when lit, the light being emitted from the LED 183 is visible only through the cutout 107*b* of the protrusion of the disc 107. In this way, when the disc 107 is spinning and the LED 183 or other light source is lit, the light emitting from the LED 183 is directed or otherwise projected outwardly through the cutout 107*b* in the protrusion 107*a* as the spinning disc 107 rotates, thereby rotatably projecting a light beam around the inside of the body 101. In this way, the light emitted from the LED 183 sequentially shines through the various generally transparent/translucent panels 118, 119, 120, 121, 122. From outside the toy police vehicle 100, it appears that the generally transparent panel means are lighting up cyclically around the body 101 and accomplishing a motorized rotatable light display 191 within the toy police vehicle 100.

Preferably, the toy police vehicle 100 also has a speaker 182 electrically connected to the circuit board 179 and the batteries 176 to play back sounds prerecorded in an integrated circuit chip (not shown) located on the circuit board 179. The prerecorded sounds include, but are not limited to, motor sounds, sirens, music, and police-related dialogue.

Preferably, the motor 181 is electrically driven with conventional batteries 176 electrically connected thereto. However, it is within the spirit and the scope of the present invention that the motor be alternatively powered, such as being spring-driven, inertia-driven, elastic-driven, air-powered, or the like. Even if an alternatively powered motor were used, the toy police vehicle 100 must still have an electrical power source to power the LED 183 and the speaker 182, if provided.

Figure 3:
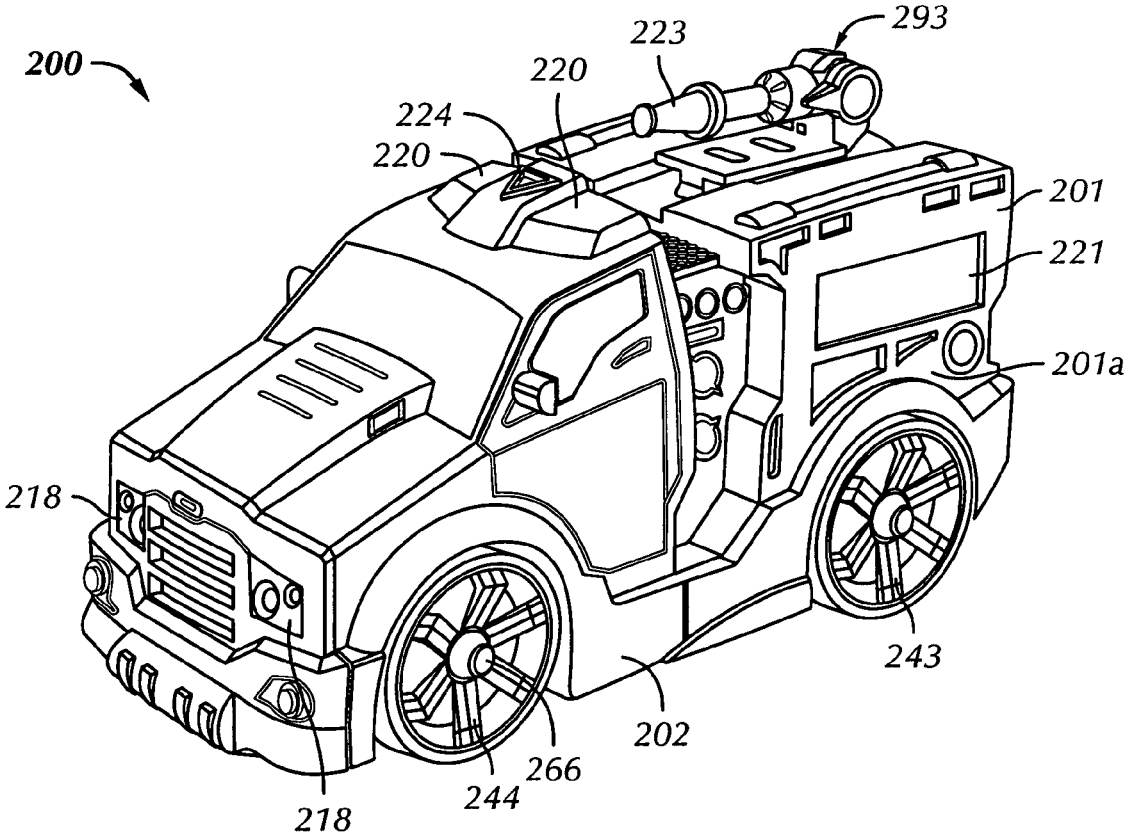
FIG. 3 is a front right perspective view of a toy vehicle in accordance with a second preferred embodiment of the present invention.
Figure 4:
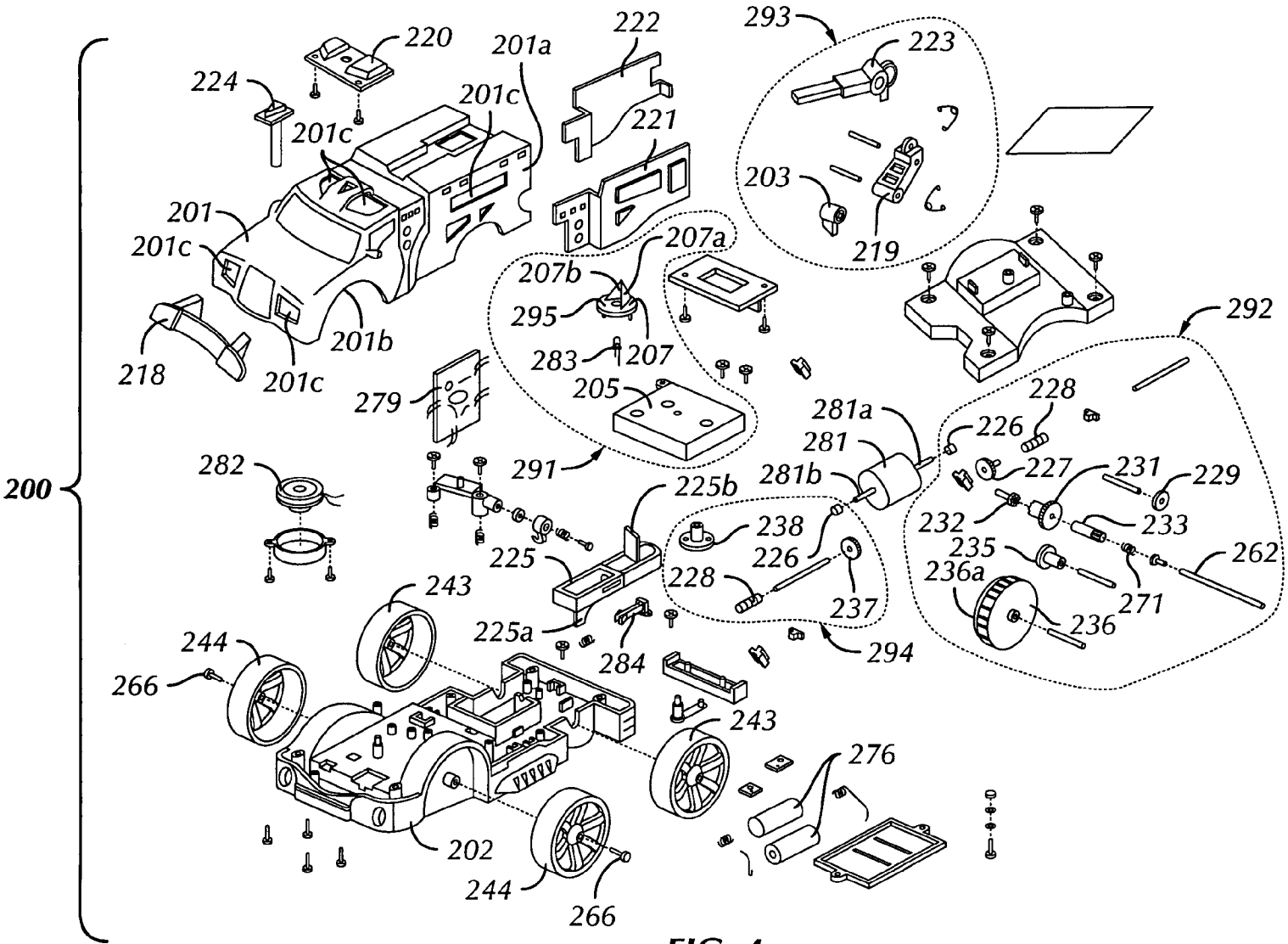
FIG. 4 is an exploded view of the toy vehicle of FIG. 3.

Referring to FIGS. 3-4, there is shown a second preferred embodiment of a toy vehicle, indicated generally at 200, in accordance with the present invention. In this embodiment, the toy vehicle 200 is designed to resemble a fire truck. Because the toy fire truck 200 is largely similar to the toy police vehicle 100, like numbers indicating like elements have been used, wherein the reference numbers of the second embodiment are increased by 100 from the corresponding reference numbers of the first embodiment. For instance, a body 201 of the toy fire truck 200 corresponds to the body 101 of the toy police vehicle 100. Because the structures of the first and second embodiments are similar, only the differences will be discussed below. Therefore, because the internal structure of the fire truck 200 is largely similar to that of the toy police vehicle 100, as can be seen when comparing FIG. 4 to FIG. 2, a discussion of the internal structure of the toy fire truck 200 will be omitted.

The differences between the toy fire truck 200 and the toy police vehicle 100 are largely aesthetic and include the fire truck styling of the body 201 and slightly differently shaped left and right side body panels 221, 222 and headlights 218 to conform to the slightly differently shaped body 201. Additionally, the toy fire truck 200 has movable member 293 engaged with the body 201. Specifically, the movable member 293 includes a pop-up hose 223 pivotably attached to the end of a pop-up hose bracket 219 which is pivotably attached to a top side of the body 201. As with the toy police vehicle 100 of the first embodiment, actuation of a button 224 on the top the body 201 initiates the lifting of the pop-up hose 223, the rotation of rear wheels 243, and the cyclic lighting of the generally transparent panels of the headlights 218, the left and right side body panels 221, 222, and top lights 220.

Figure 5:
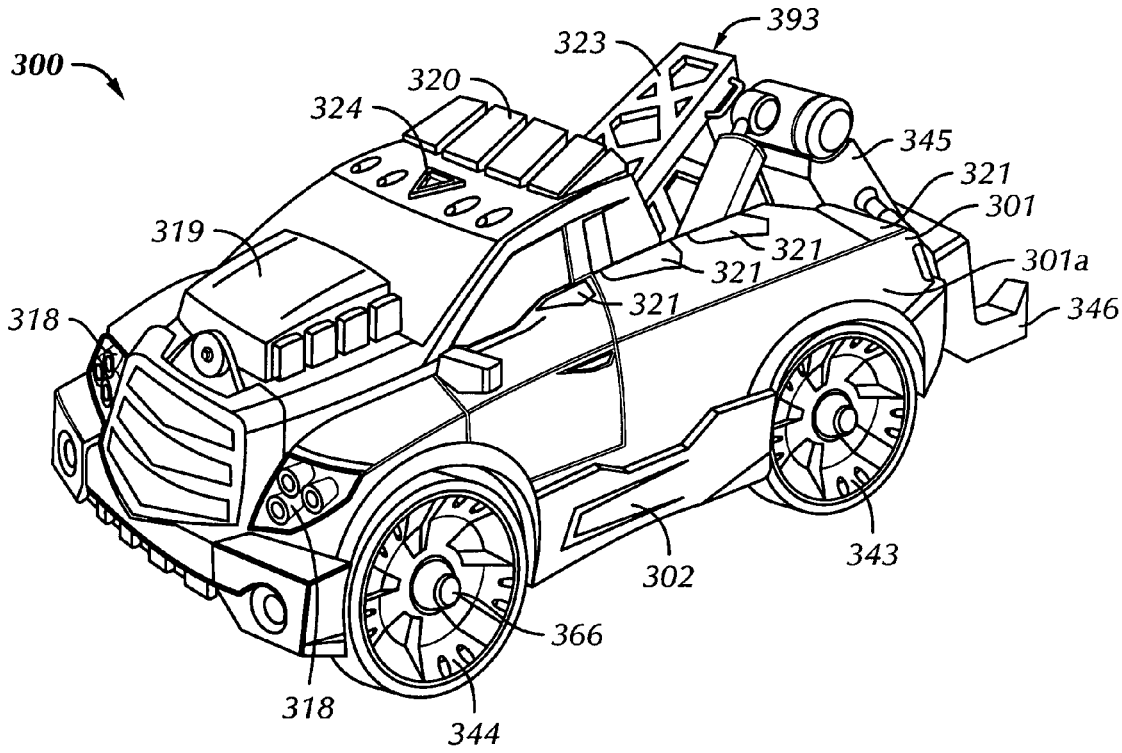
FIG. 5 is a front right perspective view of a toy vehicle in accordance with a third preferred embodiment of the present invention.
Figure 6:
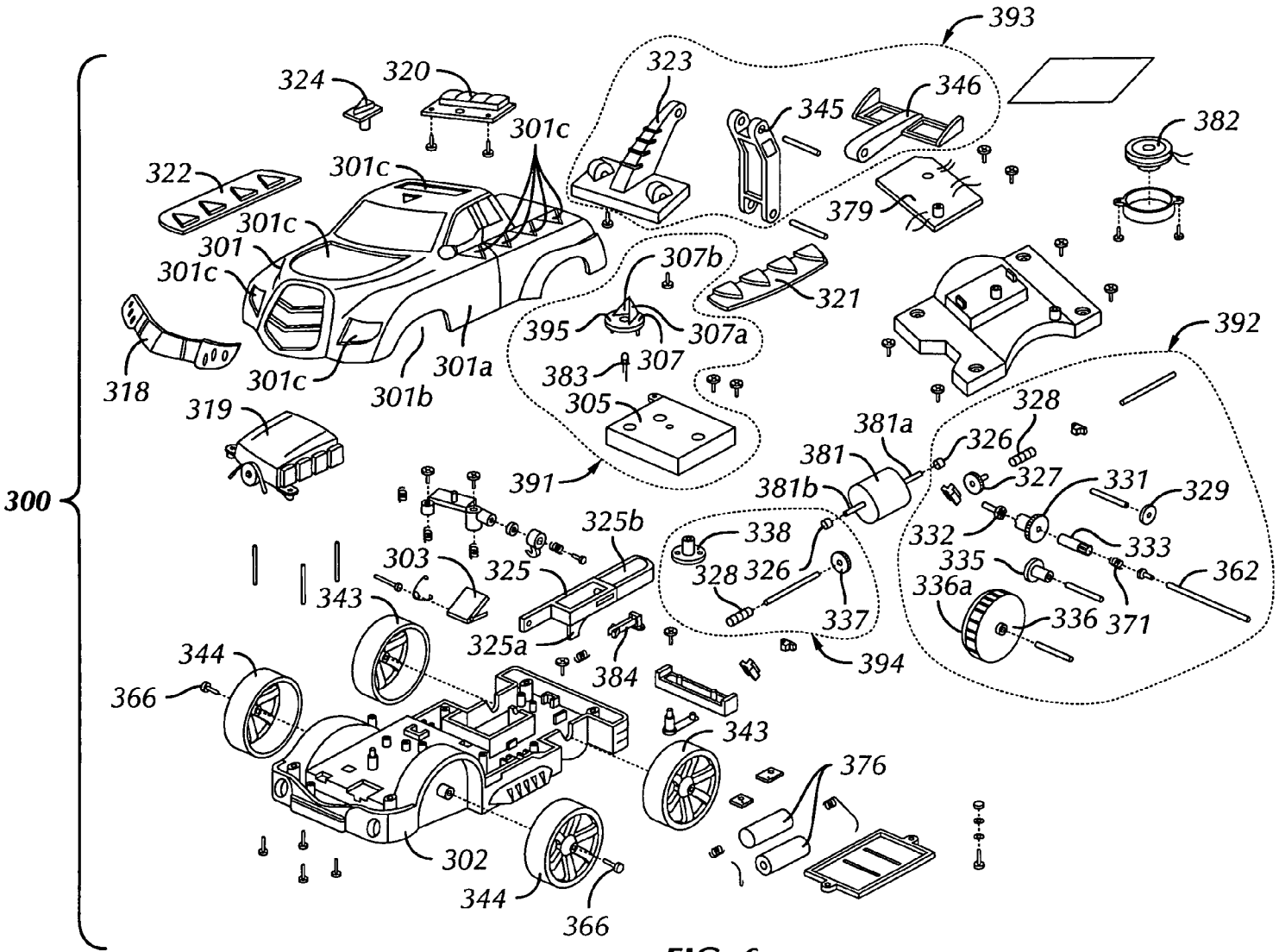
FIG. 6 is an exploded view of the toy vehicle of FIG. 5.

Referring now to FIGS. 5-6, there is shown a third preferred embodiment of a toy vehicle, indicated generally at 300, in accordance with the present invention. Again, like numbers indicating like elements have been used, wherein the reference numbers of the third embodiment are increased by 200 from the corresponding reference numbers of the first embodiment. For instance, a body 301 of the toy vehicle 300 corresponds to the body 101 of the toy police vehicle 100.

As above, only the differences will be discussed below. Again, the differences of the third embodiment are largely aesthetic and include the toy vehicle 300 styled to resemble a tow truck, as well as slightly differently shaped left and right side body panels 321, 322, headlights 318, and top light 320 to better fit the slightly differently shaped body 301 of the toy tow truck 300. Additionally, the toy tow truck 300 has an engine light panel 319 projecting through the front hood area of the body 301, which, like the rest of the generally transparent panels of the top light 320, the headlights 318, and the left and right side body panels 321, 322, is lit up by a LED 383 disposed within the body 318. The toy tow truck 300 has a base 323 mounted to the top of the body 301 proximate the rear. An end of a tow arm 345 is pivotably attached to an end of the tow arm base 323. An end of a tow frame 346 is then pivotably attached to another end of the tow arm 345. The tow arm 345 and tow frame 346 are linked to move with actuation of a button 324 disposed on the top of the body 301. Additionally, actuation of the button 324 initiates movement of rear wheels 343 and the cyclic lighting of the generally transparent panels.

Figure 7:
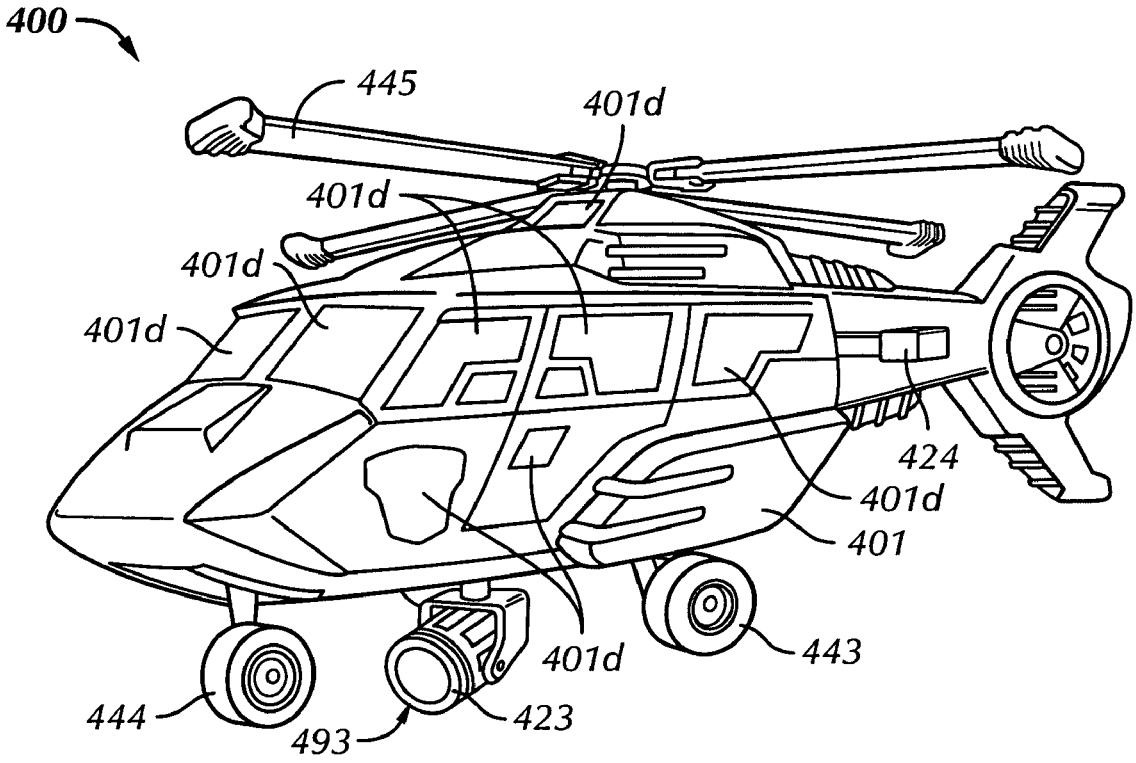
FIG. 7 is a front right perspective view of a toy vehicle in accordance with a fourth preferred embodiment of the present invention, the toy vehicle having a spotlight in an extended position.
Figure 8:
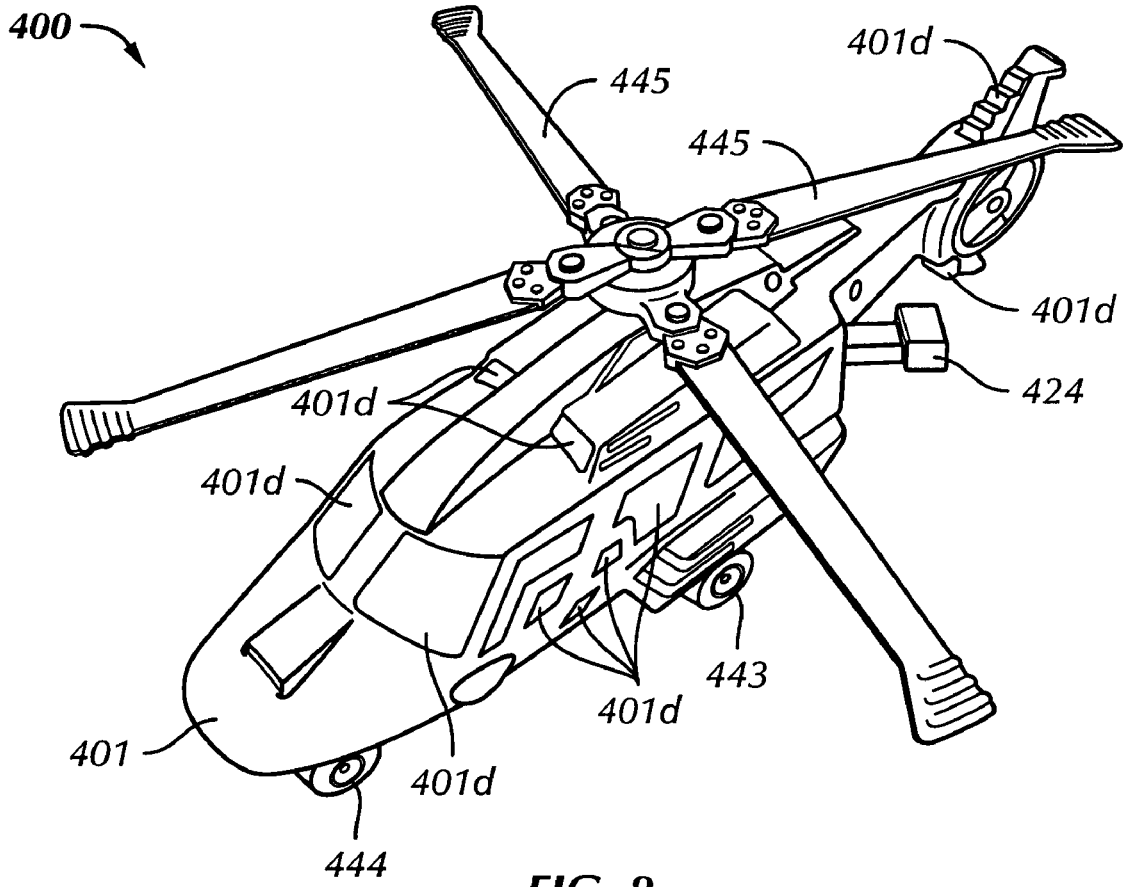
FIG. 8 is a top right perspective view of the toy vehicle of FIG. 7.
Figure 9:
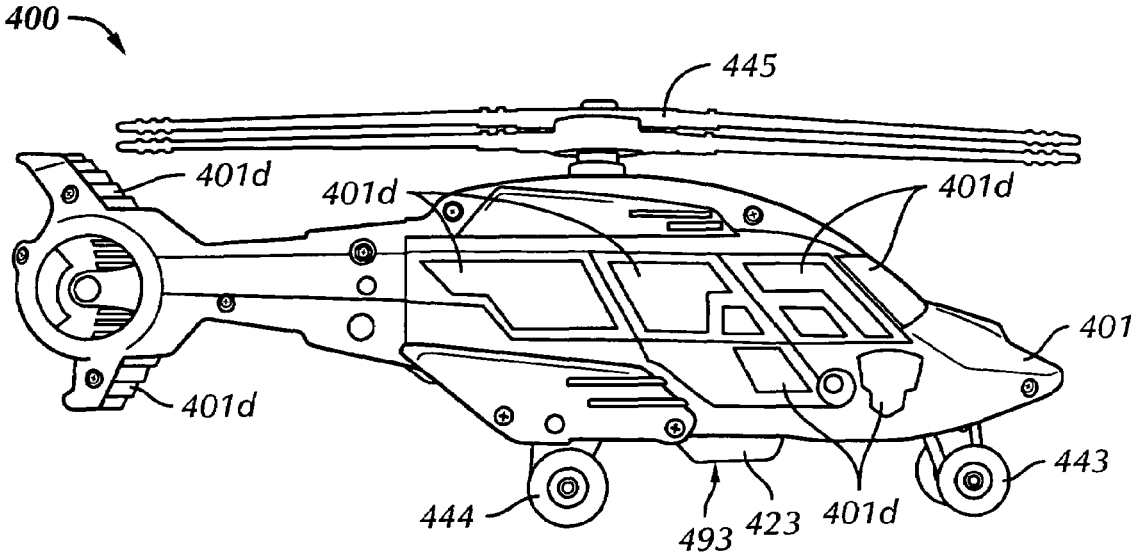
FIG. 9 is a left side elevational view of the toy vehicle of FIG. 7 having the spotlight in a retracted position.

Referring to FIGS. 7-9, there is shown a fourth preferred embodiment of a toy vehicle, indicated generally at 400, in accordance with the present invention. The toy vehicle 400 has a body 401 shaped to resemble a helicopter with a rotatable rotor 445 extending outwardly from a top side of the body 401. The toy helicopter 400 preferably has a front wheel 444 and two rear wheels 443. The toy helicopter 400 has a moveable member 493 in the form of a spotlight 423 disposed on a bottom side of the body 401. Preferably, the spotlight 423 lowers from a retracted position (FIG. 9) in the bottom side of the body 401 to an extended position (FIG. 7) and then, while in the extended position, begins at least partially rotating to move from a centrally disposed position to at least one side and then back to the centrally disposed position.

The body 401 has generally transparent panels 401*d* located around sides of the body 401, through which light from a LED (not shown) within the body 401 is cyclically displayed by means of a spinning disc (not shown) similar to that described above. Additional LEDs (not shown) can be used to light generally transparent panels 401*d* located in the tail section of the body 401, the spotlight 423, and the top side of the body 401.

Actuation of a button 424 disposed on a tail section of the body 401 causes movement of the spotlight 423, rotation of the rotor 445, and spinning of the disc to cause the cyclic lighting of the generally transparent panels 401*d*. Preferably, push actuation of the button 424 causes movement of a rack with teeth having one-way engagement with teeth of a gear engaged for rotation with a flywheel (hidden) acting as an inertia motor (hidden) to power rotation of the rotor 445 and spinning disc (hidden).

It is preferred that push activation of the button 424 further causes actuation of the spotlight 423, as described above. Preferably, pushing in of the button 424 causes generally linear motion of a cammed member (hidden) for camming interaction with a movable vertical support (hidden) for the spotlight 423. As the button 424 is pushed, the cammed member causes downward motion of the vertical support and, in turn, the spotlight 423 toward a bottom-most position. As the vertical support and spotlight 423 approach the bottom-most position, the vertical support is preferably caused to rotate, thereby rotating the spotlight 423, as described above. It is preferred that an end of travel of the button 424 generally corresponds to the bottom-most position of the vertical support and spotlight 423, such that a full push of the button 424 causes the spotlight 423 to move through the above-described full range of motion. Preferably, the vertical support and spotlight 423 is spring-biased to its original retracted position so that, when the button 424 is released, the spotlight 423 returns to the retracted position. Although this configuration is preferred, it is within the spirit and scope of the present invention that movement of the spotlight 423 be powered by the inertia motor, such that the spotlight 423 lowers from the retracted position to the extended position and back to the retracted position within a run cycle of the toy helicopter 400.

Although it is preferred that the toy helicopter 400 have an inertia motor, it is not intended to be limiting. As such, other means for powering the toy helicopter 400, such as an electric motor or the other previously listed motive devices, are within the spirit and scope of the present invention. Preferably, the LEDs are powered by conventional batteries (not shown) within the body 401.

Figure 10:
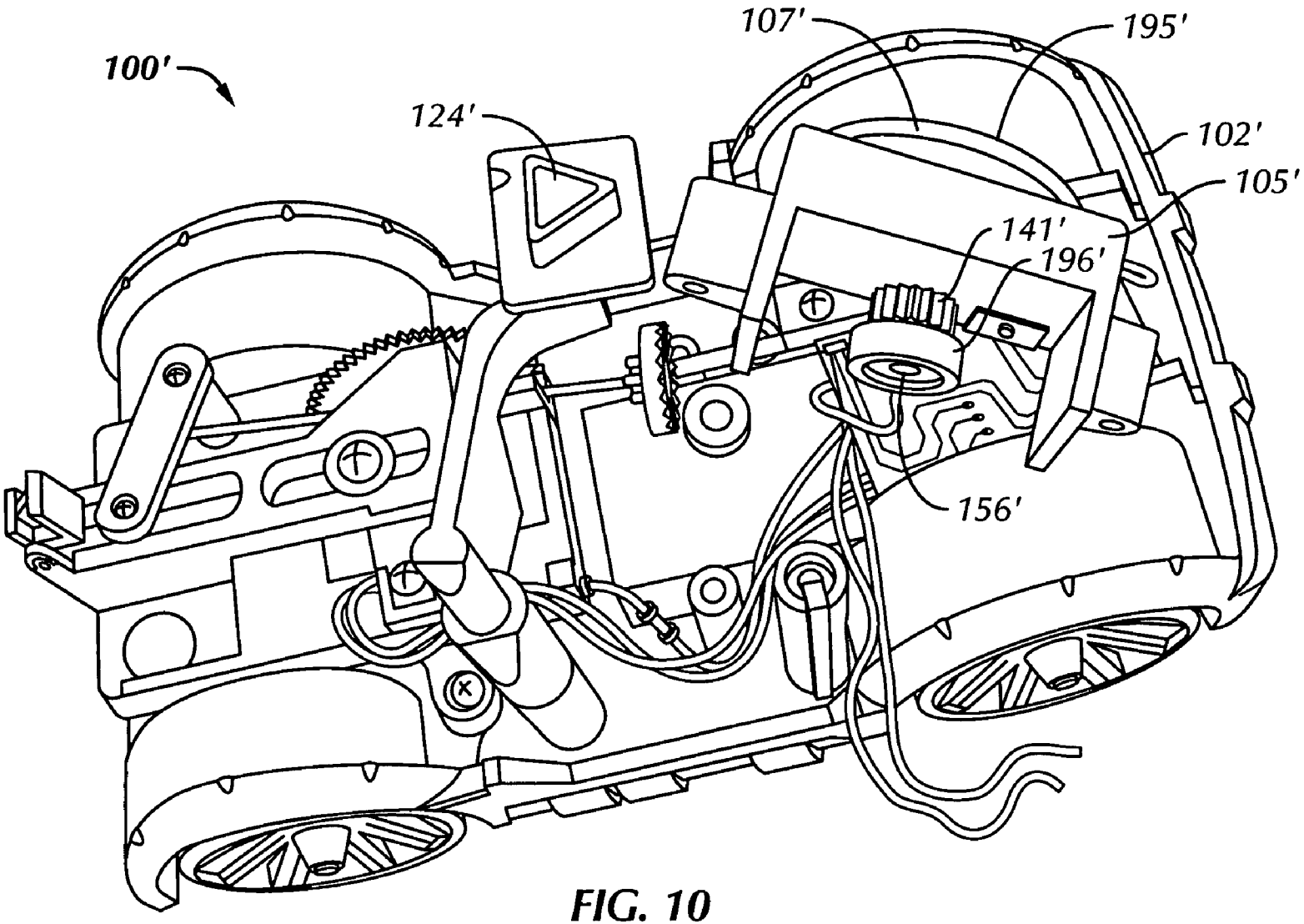
FIG. 10 is a top perspective view of the toy vehicle of FIG. 1 having a body removed to expose an alternatively configured spinning disc.
Figure 11:
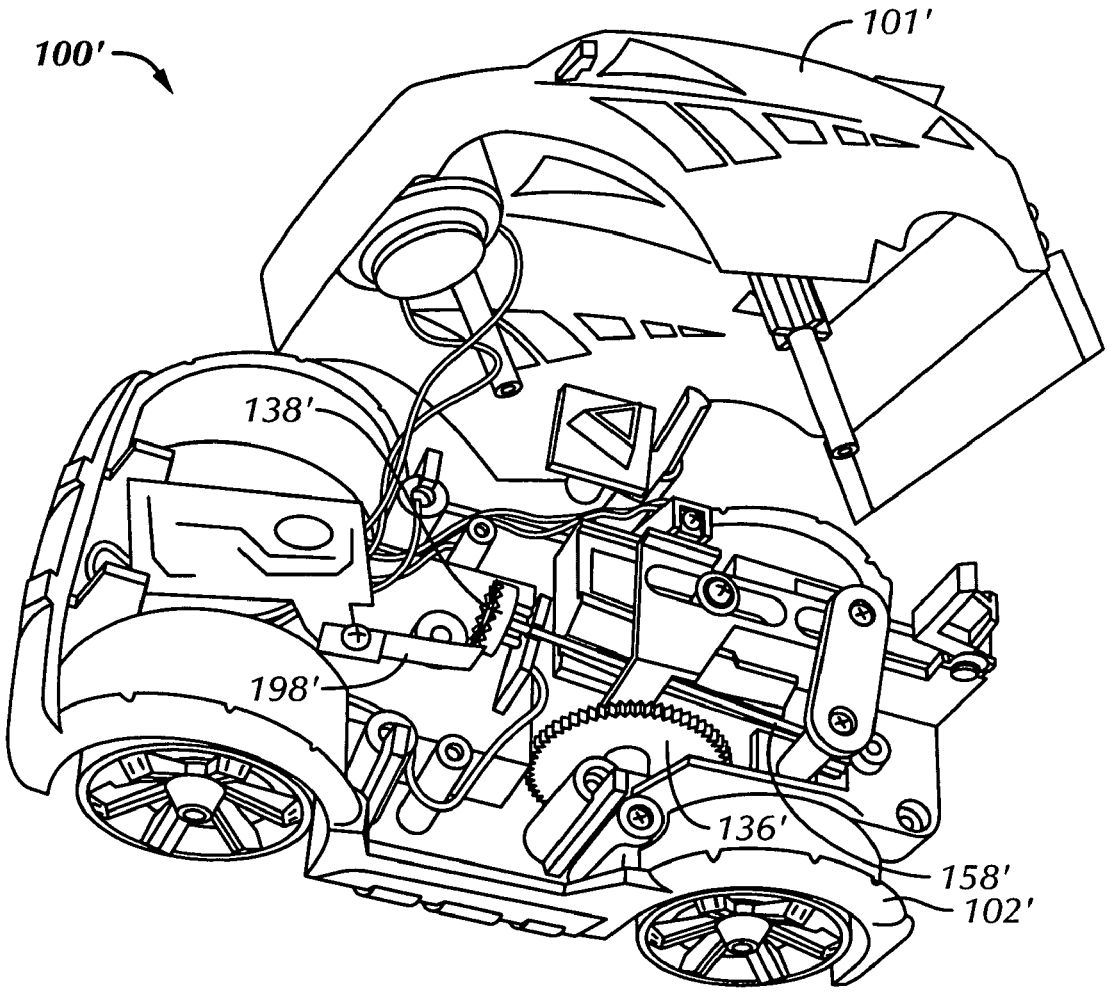
FIG. 11 is a top left perspective view of the toy vehicle of FIG. 10 having the alternatively configured spinning disc removed.
Figure 12:
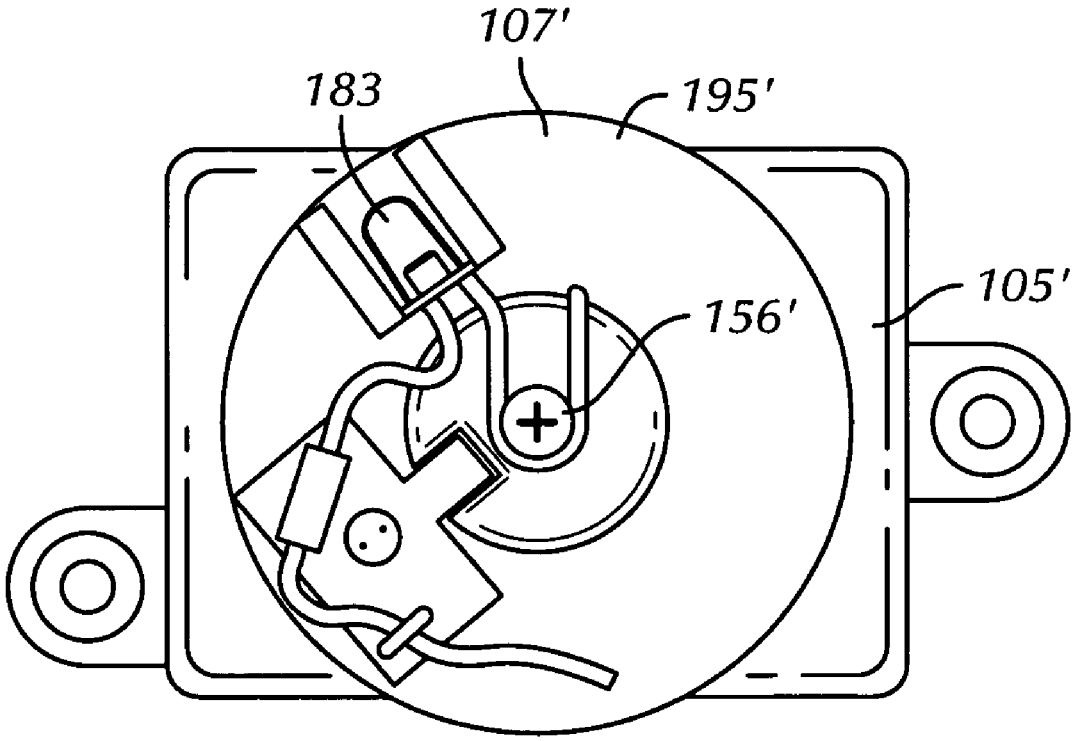
FIG. 12 is a top plan view of the alternatively configured spinning disc of FIG. 10.

Referring to FIGS. 10-12, a toy vehicle 100' is shown with an alternative rotatable member 195' having a spinning disc 107' for cyclically lighting generally transparent panel means (not shown, but similar to the panel means of the first embodiment) in a body 101' of the toy vehicle 100'. The disc 107' is rotatably mounted on a platform 105' which is anchored to a chassis 102'. The disc 107' is rotatable on an end of a shaft 156' which passes downwardly through the platform 105'. A spur gear 141' and a metallic bushing 196' are engaged with an opposite end of the shaft 156' disposed below the platform 105'. The spur gear 141' is driven by a crown gear 138' (like crown gear 138) disposed on an end of a shaft 158' (like shaft 158), which is driven by a motor (not shown). The metallic bushing 196' is directly attached to the shaft 156', which is also metallic, to establish an electrical connection therebetween. When the disc 107' and the platform 105' are attached to the chassis 102', the bushing 196' contacts a leaf spring 198', also attached to the chassis 102'. The leaf spring 198' is electrically connected to batteries (not shown) and functions to remain in contact with the bushing 196' during rotation of the disc 107' and bushing 196' in order to maintain an electrical connection. The disc 107' has a LED 183 or other light source mounted proximate an outer edge thereof facing outwardly from the center thereof, such that the LED 183 or other light source is fixedly mounted on the disc 107' of the rotatable member 195' to rotate with the rotatable member 195'. A lead of the LED 183 is wrapped around the shaft 156' to electrically couple the LED 183 to the batteries. When a run cycle is initiated by actuation of a button 124', the disc 107' begins spinning, and the LED 183 is powered in order to emit light therefrom. In this way, the light emitted from the LED 183 is rotated around the inside of the body 101' to cyclically illuminate the generally transparent panels therein, thereby accomplishing a motorized rotatable light display within the toy vehicle 100'.

Figure 13:
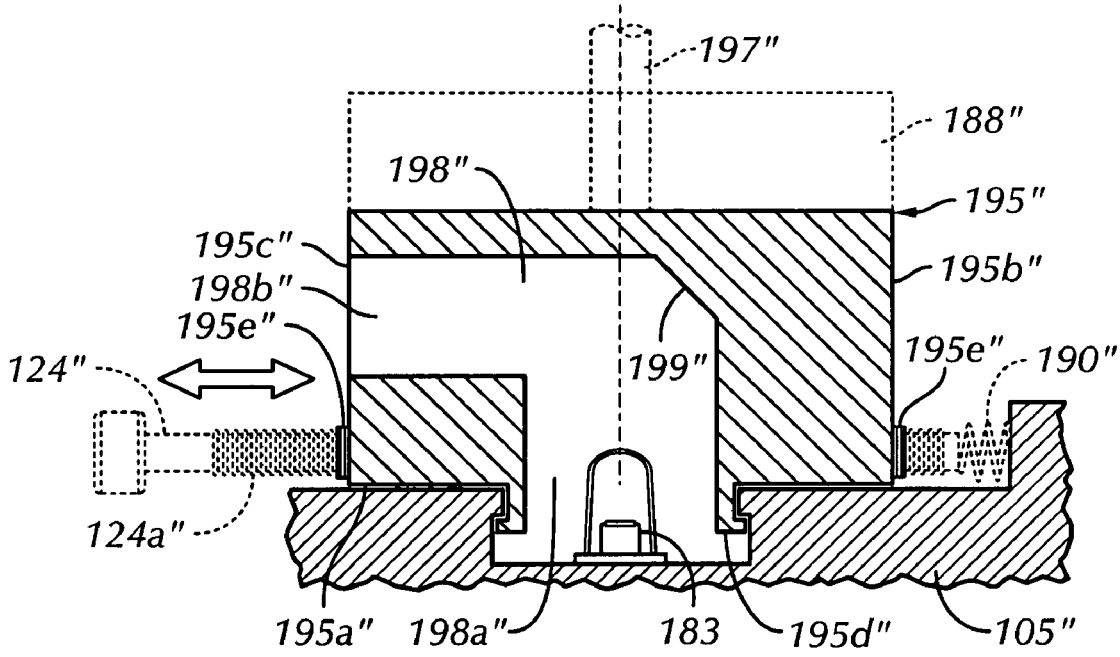
FIG. 13 is a cross-sectional view of another alternatively configured spinning disc of the toy vehicle of FIG. 1.

Referring to FIG. 13, in another aspect, a rotatable member 195" is generally similar to the rotatable members 195, 195' described above in that it functions to direct light emitted from a LED 183 or other light source within a toy vehicle (not shown, but similar to any one of the toy vehicles 100, 100', 200, 300, 400 described above). As with the previously-described rotatable members 195, 195', the rotatable member 195" is preferably rotated by a motor (not shown, but similar, if not identical, to the motor 181 described above) to cyclically direct light emitted from the LED 183 or other light source through a panel means (not shown, but similar, if not identical, to the above-described panel means). However, it is contemplated that any one of numerous other configurations could be used to cause rotation of the rotatable member 195".

For instance, a switch or push rod 124" (shown in phantom) can be used to rotate the rotatable member 195". An end of the push rod 124" is preferably accessible to the user from outside of the toy vehicle, and is preferably similar to the button 424 of the fourth embodiment described above, to allow the user to actuate the push rod 124". Preferably, the push rod 124" includes a spring 190" to bias the push rod 124" in one direction. The push rod 124" is preferably biased in a direction to allow the user to push the end of the push rod 124" in toward the toy vehicle with the spring 190" urging the push rod 124" back out to its original position, thereby allowing the user to push the push rod 124" back into the toy vehicle to further actuate the rotatable member 195". The push rod 124" preferably includes gear teeth 124*a*" on a surface thereof to mesh with the gear teeth 195*e*" of the rotatable member 195". The gear teeth 124*a*" preferably interact with the gear teeth 195*e*" in such a way as to allow the push rod 124" to impart rotation to the rotatable member 195" when moved in a first direction (i.e., when the user pushes the push rod 124" into the vehicle), but not impair rotation of the rotatable member 195" when moved in a second direction (i.e., when returning back to the original position after actuation by the user). One configuration which would allow such interaction between gear teeth 124*a*", 195*e*" is to shape the gear teeth 124*a*", 195*e*" in a saw-tooth manner, although there are numerous other configurations in which such interaction between gear teeth 124*a*", 195*e*" can be accomplished, all of which are contemplated by the present invention. The rotatable member 195" preferably further includes a weighted flywheel 188" (shown in phantom) operably engaged therewith in an inertia motor configuration, whereby actuation of the push rod 124" causes rotation of the flywheel 188" and the rotatable member 195". The additional mass of the flywheel 188" increases the inertia of the system so that, once rotation of the flywheel 188" is achieved, the flywheel 188" tends to increase the duration of rotation of the system, particularly the rotatable member 195".

The rotatable member 195" preferably is rotatable with respect to a platform 105" within a housing (not shown) of a toy vehicle (not shown, but similar to the above-described toy vehicles 100, 100', 200, 300, 400). Preferably, the rotatable member 195" has an integral shaft 195*d*" extending downwardly from a bottom 195*a*" of the rotatable member 195", which is rotatably engaged with the platform 105", although other configurations are contemplated, such as, but not limited to a shaft 197" (shown in phantom) fixed to a top of the rotatable member 195" to rotatably mount the rotatable member 195" to the toy vehicle. The rotatable member 195" preferably has gear teeth 195*e*" disposed around at least a portion of an outer circumferential edge 195*b*" thereof to mesh with a gear (not shown) driven by the motor in order to operably couple the rotatable member 195" with the motor, thereby driving the rotatable member 195".

Preferably, the rotatable member 195" includes a channel 198" having first and second portions 198*a*", 198*b*", preferably forming an L-shape with each of the first and second portions 198*a*", 198*b*" forming one of the legs of the "L". Preferably, the first portion 198*a*" of the channel 198" extends through the hollow integral shaft 195*d*". The LED 183 or other light source is disposed at least partially within the first portion 198*a*" of the channel 198" and is preferably fixed to the platform 105" so that the rotatable member 195" rotates with respect to the LED 183 or other light source. Preferably, the LED 183 or other light source extends at least partially within the hollow integral shaft 195*d*" of the rotatable member 195", so as to be disposed at least partially within the first portion 198*a*" of the channel 198".

Preferably, a mirror 199" is disposed within the channel 198" and is oriented to direct light emitted from the LED 183 or other light source from the first portion 198*a*" into the second portion 198*b*" of the channel 198" and radially outwardly from the channel 198" as a beam. The rotatable member 195" has a bottom 195*a*" and an outer circumferential edge 195*b*" with a hole 195*c*" disposed in the outer circumferential edge 195*b*". Preferably, the first portion 198*a*" of the channel 198" extends substantially upwardly from the bottom 195*a*" and the second portion 198*b*" extends radially outwardly from the first portion 198*a*" to the hole 195*c*" in the outer circumferential edge 195*b*". In this way, as the rotatable member 195" rotates, a beam of light is projected outwardly from the hole 195*c*" of the rotatable member 195" to cyclically illuminate the generally transparent panel means therein, thereby accomplishing a motorized rotatable light display within the toy vehicle.

Additional details and description of the structure and operation of various pop-out and pop-up accessory features, which can be incorporated into any of the toy vehicles 100, 200, 300, 400, 100' of the present invention, can be found in U.S. Pat. No. 6,764,376 B2, entitled "Spring-Driven Toy Vehicle", and U.S. Patent Application Publication No. 2005/0042974 A1, entitled "Lever and Wheel Activated Toy Vehicles", the disclosures of which are incorporated by reference herein in their entireties.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

We claim:

1. A toy vehicle with a rotatable light display, the toy vehicle comprising:

a housing defined by outer walls surrounding a hollow interior and at least substantially forming a toy vehicle body, the housing having a plurality of openings through the outer walls;

at least translucent panel means coupled to the housing and aligned with the plurality of openings;

a motor mounted within the hollow interior;

a light source within the hollow interior; and a rotatable member drivingly connected to the motor in the interior so as to be rotated by operation of the motor and positioned with respect to the light source so as to direct at least one beam of light emitted from the light source about the hollow interior and sequentially and cyclically through the plurality of openings and aligned translucent panel means.

2. The toy vehicle of claim 1 further comprising a movable member mounted on the housing and operably connected to the motor, whereby operation of the motor additionally causes movement of the movable member with respect to the housing.

3. The toy vehicle of claim 1, wherein the light source is fixedly and stationarily mounted to the housing extending at least into the rotatable member so as to be partially shielded by the rotation member.

4. The toy vehicle of claim 3, wherein the rotatable member comprises a disc with a hollow protrusion extending axially from the disc, the hollow protrusion including a radial cutout, the light source being disposed within the protrusion such that light emitted from the light source is directed outwardly through the cutout in the protrusion as the beam.

5. The toy vehicle of claim 3, wherein the rotatable member includes:

a channel having a first portion and a second portion, the light source being disposed at least partially within the first portion of the channel; and a mirror disposed within the channel and oriented to direct light emitted from the light source from the first portion of the channel into the second portion of the channel and radially outwardly from the channel as the beam.

6. The toy vehicle of claim 5, wherein the rotatable member has a bottom and an outer circumferential edge with a hole disposed in the outer circumferential edge, such that the first portion of the channel extends substantially upwardly from the bottom and the second portion extends radially outwardly from the first portion to the hole in the outer circumferential edge.

7. The toy vehicle of claim 1, wherein the light source is fixedly mounted on the rotatable member to rotate with the rotatable member.

8. The toy vehicle of claim 1, wherein the light source is a light emitting diode.

9. The toy vehicle of claim 1 further comprising a plurality of road wheels rotatably engaged with the housing so as to support the housing for movement across a surface, at least one of the plurality of road wheels being drivingly connected with the motor such that operation of the motor further causes rotation of the at least one road wheel.

10. The toy vehicle of claim 1, wherein the motor includes a flywheel rotatably engaged with the vehicle.

11. The toy vehicle of claim 1, wherein the motor is an electric motor powered by at least one battery within the vehicle.

12. The toy vehicle of claim 1, wherein the motor is an inertia motor powered by user actuation of a switch mounted on the housing.

13. The toy vehicle of claim 1, wherein actuation of a button disposed on the vehicle causes at least powering of the light source and rotation of the rotatable member.

14. The toy vehicle of claim 1, wherein at least the light source and motor operate for a predetermined amount of time before automatically shutting off.

15. In a toy vehicle having a housing defined by outer walls surrounding a hollow interior, the housing having a plurality of openings through the outer walls and at least translucent panel means coupled to the housing and aligned with the plurality of openings, the vehicle further having a motor disposed within the hollow interior, a rotatable light display comprising:

a light source within the hollow interior; and a rotatable member drivingly connected to the motor in the hollow interior so as to be rotated by operation of the motor and positioned with respect to the light source so as to direct at least one beam of light emitted from the light source about the hollow interior and sequentially and cyclically through the plurality of openings and aligned translucent panel means.

16. The rotatable light display of claim 15, wherein the light source is fixedly and stationarily mounted to the housing and extends at least sufficiently into the rotatable member so as to be partially shielded by the rotatable member.

17. The rotatable light display of claim 16, wherein the rotatable member comprises a disc and a hollow protrusion extending axially from the disc, the hollow protrusion including a radial cutout, the light source being disposed within the protrusion such that light emitted from the light source is directed outwardly through the cutout in the protrusion as the beam.

18. The rotatable light display of claim 16, wherein the rotatable member comprises a gear driven by the motor.

19. The rotatable light display of claim 18, wherein the rotatable member further comprises:

a channel in the gear, the channel having a first portion and a second portion, the light source being disposed at least partially within the first portion of the channel; and a mirror disposed within the channel and oriented to direct light emitted from the light source from the first portion of the channel into the second portion of the channel and radially outwardly from the channel of the gear.

20. The rotatable light display of claim 19, wherein the gear has a bottom and an outer circumferential edge with a hole disposed in the outer circumferential edge, such that the first portion of the channel extends substantially upwardly from the bottom and the second portion extends radially outwardly from the first portion to the hole in the outer circumferential edge.

21. The rotatable light display of claim 15, wherein the light source is fixedly mounted on the rotatable member to rotate with the rotatable member.

22. The rotatable light display of claim 15, wherein the light source is a light emitting diode.

23. The rotatable light display of claim 15, wherein actuation of a button disposed on the toy vehicle causes at least the rotatable light display to begin operation.

24. The rotatable light display of claim 23, wherein at least the rotatable light display operates for a predetermined amount of time before automatically shutting off.

* * * * *